US006134337A

United States Patent [19]

Isaka

[11] Patent Number: 6,134,337

[45] Date of Patent: Oct. 17, 2000

[54] LOUDSPEAKER

[75] Inventor: Takashi Isaka, Kamakura, Japan

[73] Assignees: Bell Tech Co., Ltd., Kanagawa; Foster Electric Co., Ltd., Tokyo, both of Japan

[21] Appl. No.: 08/987,764

[22] Filed: Dec. 9, 1997

[30] Foreign Application Priority Data

Dec. 11, 1996 [JP] Japan ..... 8-352184
May 6, 1997 [JP] Japan ..... 9-131753

[51] Int. Cl.[7] ..... H04R 25/00

[52] U.S. Cl. ..... 381/423; 381/424; 181/164

[58] Field of Search ..... 381/423, 424, 381/430, 432, FOR 162; 181/164, 165, 173

[56] References Cited

U.S. PATENT DOCUMENTS 3,862,376 1/1975 White .
4,086,450 4/1978 Inoue .
4,881,617 11/1989 Faraone .
5,880,412 3/1999 Faraone .

FOREIGN PATENT DOCUMENTS 53-142032 4/1979 Japan .
63-27429 11/1988 Japan .

*Primary Examiner*—Curtis A. Kuntz
*Attorney, Agent, or Firm*—McDermott, Will & Emery

[57] ABSTRACT

In a loudspeaker, a diaphragm is equally divided circumferentially into a plurality of regions which have the same shape with each other. Each of the divided regions is formed by a hyperbolic paraboloid. The hyperbolic paraboloid is obtained by moving a straight line connecting between two segments along these two segments. The hyperbolic paraboloid is large in strength and can suppress generation of the dividing vibration of the diaphragm.

6 Claims, 13 Drawing Sheets

LOUDSPEAKER

BACKGROUND OF THE INVENTION

1. Field of the Invention

The present invention relates to a loudspeaker for use in, for example, an audio system and, in particular, to a diaphragm of the loudspeaker.

2. Description of the Prior Art

As shown in FIG. 18, a loudspeaker includes a cone-type diaphragm 11. At a base end side (small-diameter side) of the diaphragm 11, a voice coil 12 is provided. By changing a magnetic field around the voice coil 12 depending on a sound signal, a magnetic force between a magnet (not shown) and the voice coil 12 is changed so as to vibrate the diaphragm 11 forward and backward, that is, along a center axis of the diaphragm 11. The diaphragm 11 is normally made of paper and formed into a conical shape. A large-diameter side opening edge (outer peripheral edge) 13 of the diaphragm 11 is held by an elastic ring (not shown) so that the diaphragm 11 can vibrate forward and backward. Since the vibration state of the diaphragm 11 controls a regenerative frequency characteristic, a high-frequency distortion frequency characteristic and the like, the performance of the loudspeaker is essentially determined by the diaphragm 11.

The ideal vibration is such that the diaphragm 11 makes forward and backward motions while maintaining its original conical shape. However, in practice, the diaphragm 11 presents behavior deviated from the ideal vibration. Recently, since the observation technique and the computer processing for the vibration state have been advanced, the actual vibration state has been largely elucidated. It has been known that, as shown in FIG. 19A, the diaphragm 11 may be twisted to cause corrugation of the large-diameter side opening edge 13, or, as shown in FIG. 19B, the circumference of the diaphragm 11 is corrugated to form nodes of the vibration while keeping axial symmetry. This behavior is called dividing vibration.

The reason for the behavior is considered as follows:

For example, immediately upon backward displacement of the diaphragm 11, since the large-diameter side opening edge 13 thereof tries to stay at the position due to inertia, it is resultantly contracted toward the center axis of the diaphragm 11. Thus, as shown in FIG. 20, compressive forces are generated at any circumferential portions of the diaphragm 11. In contrast with this, immediately upon forward displacement of the diaphragm 11, tensile forces are generated at any circumferential portions of the diaphragm 11.

Accordingly, as described above, the ideal behavior is not accomplished to thereby degrade the sound quality. The conventional loudspeaker has the basic problem as noted above, which thus causes the following problems:

For ensuring sufficient sound pressures at a low-frequency region, the diaphragm 11, which is thick and large, is required. Thus, the diaphragm 11 becomes heavy to increase its moment of inertia. The dividing vibration becomes greater as the moment of inertia becomes greater or the vibration frequency becomes greater (as the frequency of occurrences of crests and troughs on the circumference of the diaphragm 11 becomes greater). Eventually, the loudspeaker incorporating such a diaphragm 11 can be only used at the low-frequency region.

On the other hand, for using the diaphragm 11 at a high-frequency region, since an influence of the dividing vibration is large, the moment of inertia is required to be small. Thus, the diaphragm 11, which is small in thickness and large in strength, is required. Even if the diaphragm 11 is thin, the sufficient sound pressures can be ensured at the high-frequency region. However, in this case, the loudspeaker incorporating such a diaphragm 11 can not be used at the low-frequency region, and further, it is necessary to use titanium, beryllium or the like, which is expensive, as a material of the diaphragm 11.

SUMMARY OF THE INVENTION

Therefore, it is an object of the present invention to provide a loudspeaker which can suppress the dividing vibration and thus accomplish the good quality of sound.

According to one aspect of the present invention, there is provided a loudspeaker comprising a diaphragm, wherein the diaphragm is formed by a hyperbolic paraboloid which is obtained by moving a straight line connecting between two segments along the two segments.

According to another aspect of the present invention, there is provided a loudspeaker comprising a diaphragm which is circumferentially divided into a plurality of regions each having a first segment forming a peripheral edge thereof, wherein each of the divided regions is formed by a hyperbolic paraboloid which is obtained by moving a straight line connecting between the first segment and a second segment located inward of the first segment and not located in the same plane with respect to the first segment, along the first and second segments.

According to another aspect of the present invention, there is provided a loudspeaker comprising a diaphragm which is circumferentially divided into a plurality of regions each having a first segment forming a peripheral edge thereof, wherein each of the divided regions is formed by a pair of hyperbolic paraboloids which are obtained by moving a straight line connecting between the first segment and a second segment located in a plane including a middle point of the first segment and a center axis of the diaphragm and not located in the same plane with respect to the first segment, from the middle point of the first segment to both ends of the first segment and from one end of the second segment to the other end thereof.

It may be arranged that the second segment corresponds to the center axis of the diaphragm.

It may be arranged that the second segment extends outward from the center axis of the diaphragm.

It may be arranged that the number of the divided regions of the diaphragm is set to an odd number.

The present invention covers a case wherein the diaphragm is formed by a portion or portions of the hyperbolic paraboloid(s). Further, in the present invention, the hyperbolic paraboloid includes not only a perfect hyperbolic paraboloid, but also such a curved surface that is approximate to the perfect hyperbolic paraboloid. Moreover, the word "segment" represents a segment of a straight line or a chord of a curved line.

BRIEF DESCRIPTION OF THE DRAWINGS

The present invention will be understood more fully from the detailed description given hereinbelow, taken in conjunction with the accompanying drawings.

In the drawings:

FIGS. 13A to 13C are diagrams showing a diaphragm of a loudspeaker according to a fifth preferred embodiment of the present invention, wherein FIG. 13A is a perspective view, FIG. 13B is a side view and FIG. 13C is a plan view;

FIGS. 14A and 14B are diagrams showing a diaphragm of a loudspeaker according to a sixth preferred embodiment of the present invention, wherein FIG. 14A is a perspective view and FIG. 14B is a side view;

FIGS. 17A and 17B are characteristic diagrams, wherein FIG. 17A shows a relationship between sound pressures and frequencies with the center axis L passing the center O of the circle (large-diameter side opening edge) 21 and being orthogonal to a plane including the circle 21, two points located at positions distanced from the center O in the same direction are given as P1 and P2. On the other hand, an arcuate segment forming a part of the circle 21 is given as AC, and AC includes arcuate segments AB and BC wherein B is the middle point of AC. By moving a straight line connecting between B and P1 along a straight segment P1P2 and along the arcuate segment BC, a curved surface is formed at a region defined by B, P1, P2 and C. Specifically, the curved surface is formed by moving an outer end of the straight line BP1 from B to C at a constant speed while moving an inner end of the straight line BP1 from P1 to P2 at a constant speed.

In other words, the foregoing curved surface is formed by equally dividing the arcuate segment BC into k (k is an integer) regions, equally dividing the straight segment P1P2 into k regions and connecting between the corresponding equally divided points. This curved surface is formed by a group of straight lines and called a hyperbolic paraboloid and, as shown in FIG. 2B, includes hyperbolas and parabolas. Similarly, by moving the straight line BP1 along the straight segment P1P2 and along the arcuate segment BA, a hyperbolic paraboloid is formed at a region defined by B, P1, P2 and A. With respect to the other divided regions S2 to S4, hyperbolic paraboloids are also formed in the same fashion. Accordingly, the hyperbolic paraboloids spread at both sides of each of straight lines connecting between B and the center axis L, and hence, on the whole, crests (regions connecting between B and P1) and troughs (regions respect to a conventional loudspeaker and FIG. 17B shows a relationship between sound pressures and frequencies with respect to the loudspeaker shown in FIGS. 9 and 10;

DESCRIPTION OF THE PREFERRED EMBODIMENT

Now, preferred embodiments of the present invention will be described hereinbelow with reference to the accompanying drawings. Throughout the specification and claims, the word "segment" represents a segment of a straight line or a chord of a curved line.

Figure 1:
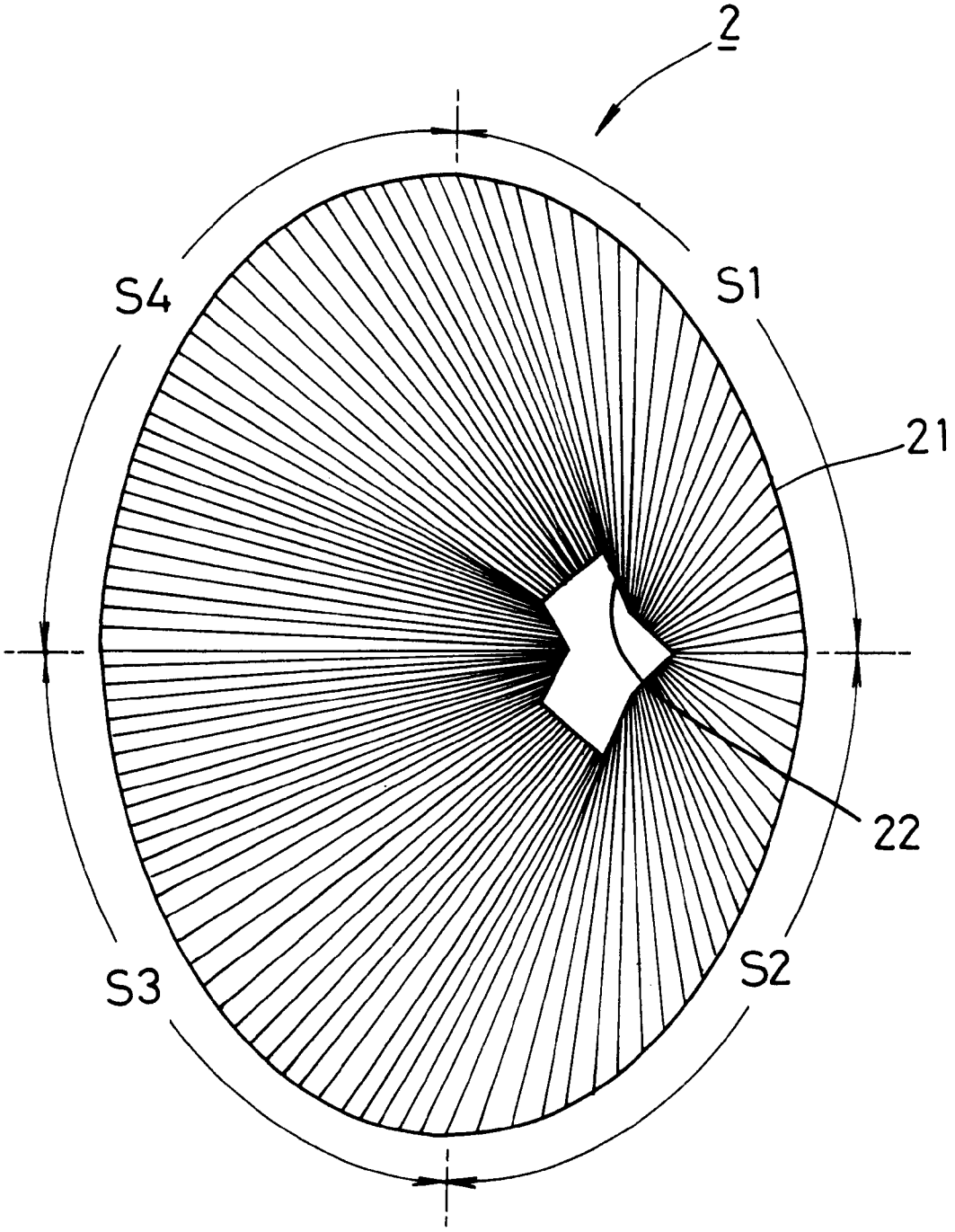
FIG. 1 is a perspective view showing a diaphragm of a loudspeaker according to a first preferred embodiment of the present invention.

FIG. 1 is a perspective view showing a diaphragm 2 incorporated in a loudspeaker according to the first preferred embodiment of the present invention. The diaphragm 2 does not have the conical shape as in the prior art, but is formed by hyperbolic paraboloids. When the diaphragm 2 is equally divided into four regions in a circumferential direction (circumferentially) thereof and S1 to S4 are assigned to the four regions, respectively, S1 to S4 have the same shape. A large-diameter side opening edge 21 has a circular shape. Accordingly, if the opening edge 21 is taken as a circular line (circle), a peripheral edge of each of S1 to S4 is formed by an arcuate segment (chord) corresponding to a quarter of the circle.

Figure 2A:
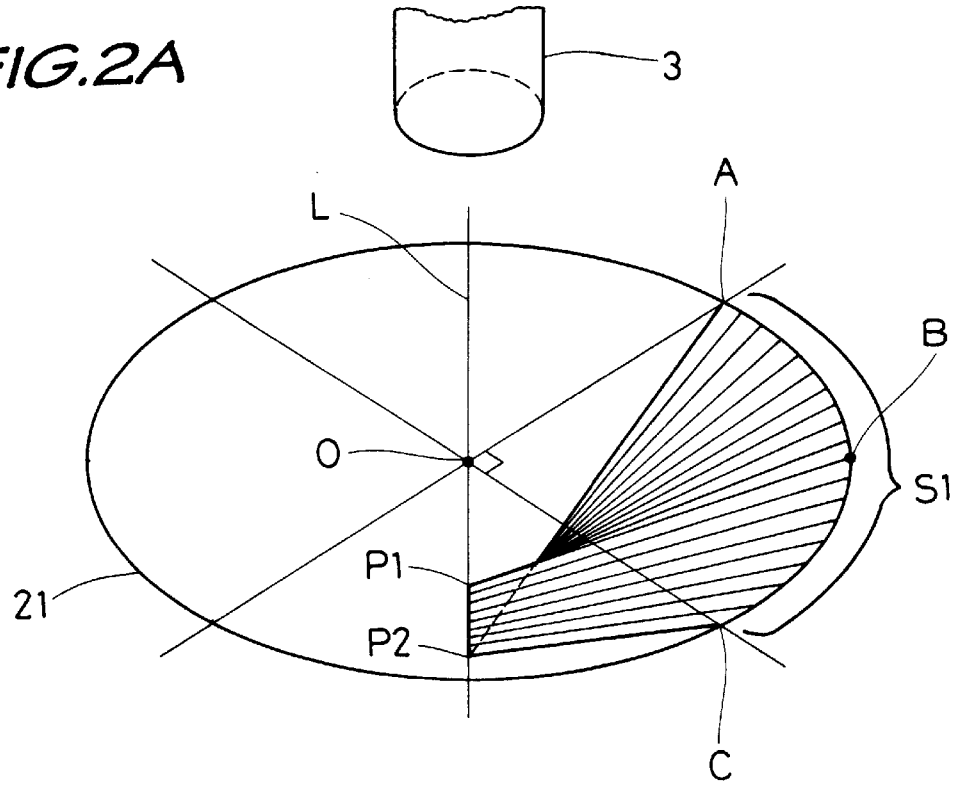
FIGS. 2A and 2B are diagrams for explaining curved surfaces of the diaphragm according to the first preferred embodiment of the present invention.
Figure 2B:
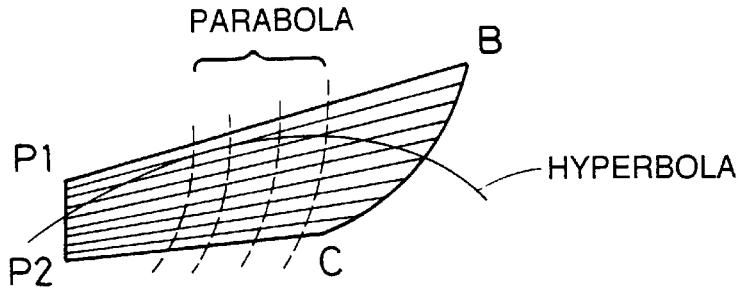
Figure 3:
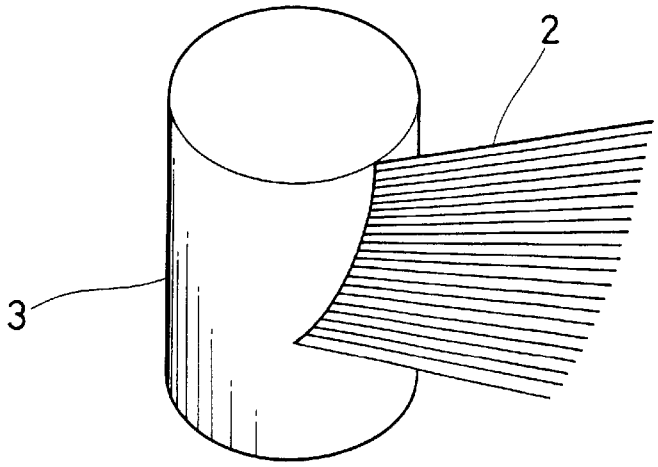
FIG. 3 is a perspective view showing a coupling portion between the diaphragm and a cylindrical member according to the first preferred embodiment of the present invention.

Since the divided regions S1 to S4 have the same shape, a structure of S1 will be described hereinbelow. As shown in FIG. 2A, on connecting between A or C and P2) are formed alternately with each other in the circumferential direction. Then, as shown in FIG. 3, the foregoing hyperbolic paraboloids are penetrated by a cylindrical member 3 whose center axis is the center axis L and whose radius is, for example, about a quarter of a radius of the circle 21. The surfaces extending from the circumference of the cylindrical member 3 to the circle 21 form the shape of the diaphragm 2 shown in FIG. 1.

Figure 4:
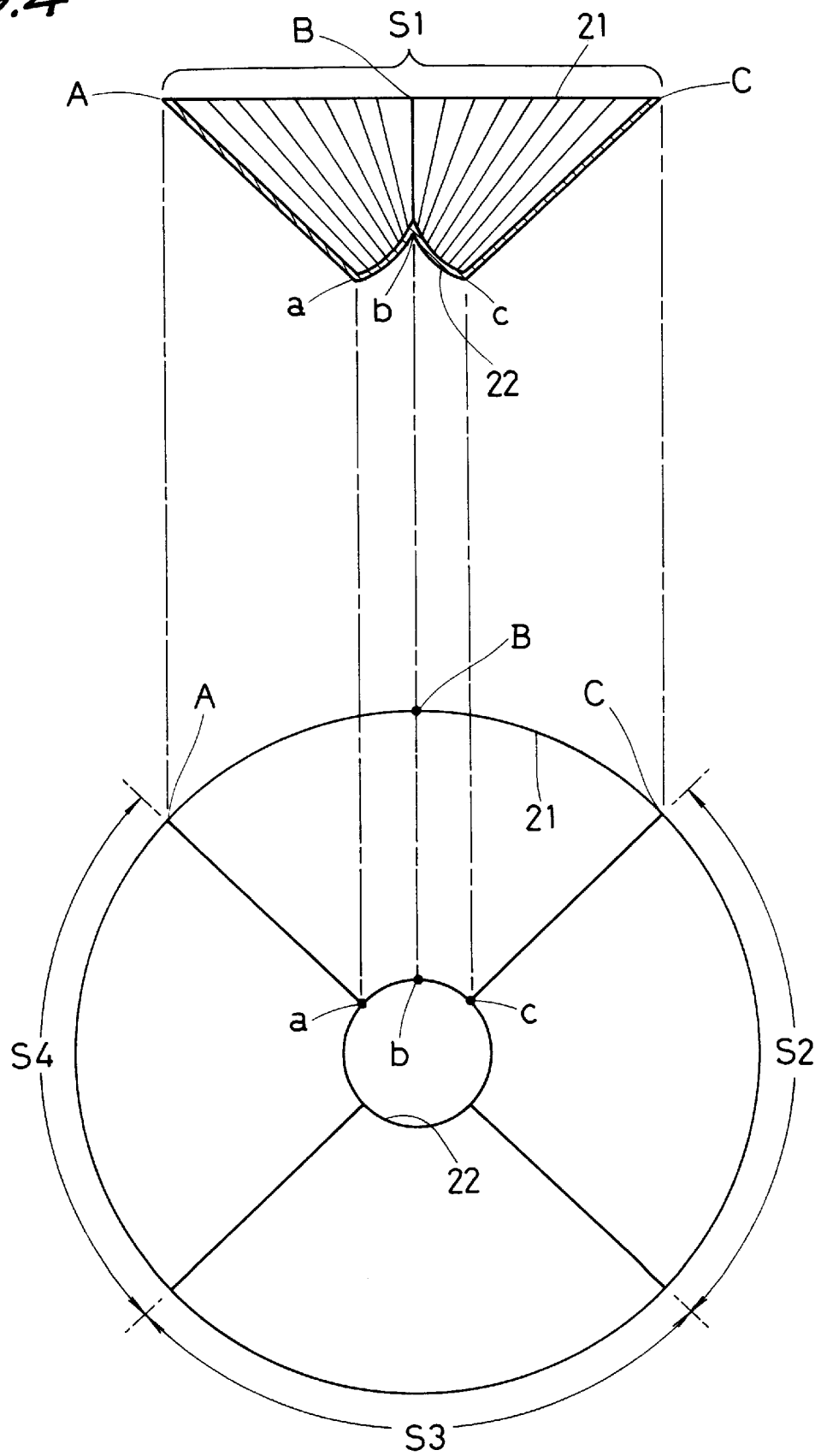
FIG. 4 is a diagram for explaining the shape of the diaphragm according to the first preferred embodiment of the present invention.

FIG. 4 is a diagram for explaining the shape of the diaphragm 2 and includes a sectional view of the divided region S1 as seen from the side of the center axis L and a top view of the whole diaphragm 2 as seen from above. Seeing from the side of the center axis L, a small-diameter side opening edge (inner peripheral edge) 22 has the shape of a mountain (abc). The diaphragm 2 having the foregoing shape is designed, for example, by computer graphics and made of paper, carbon, metal or the like.

Figure 5:
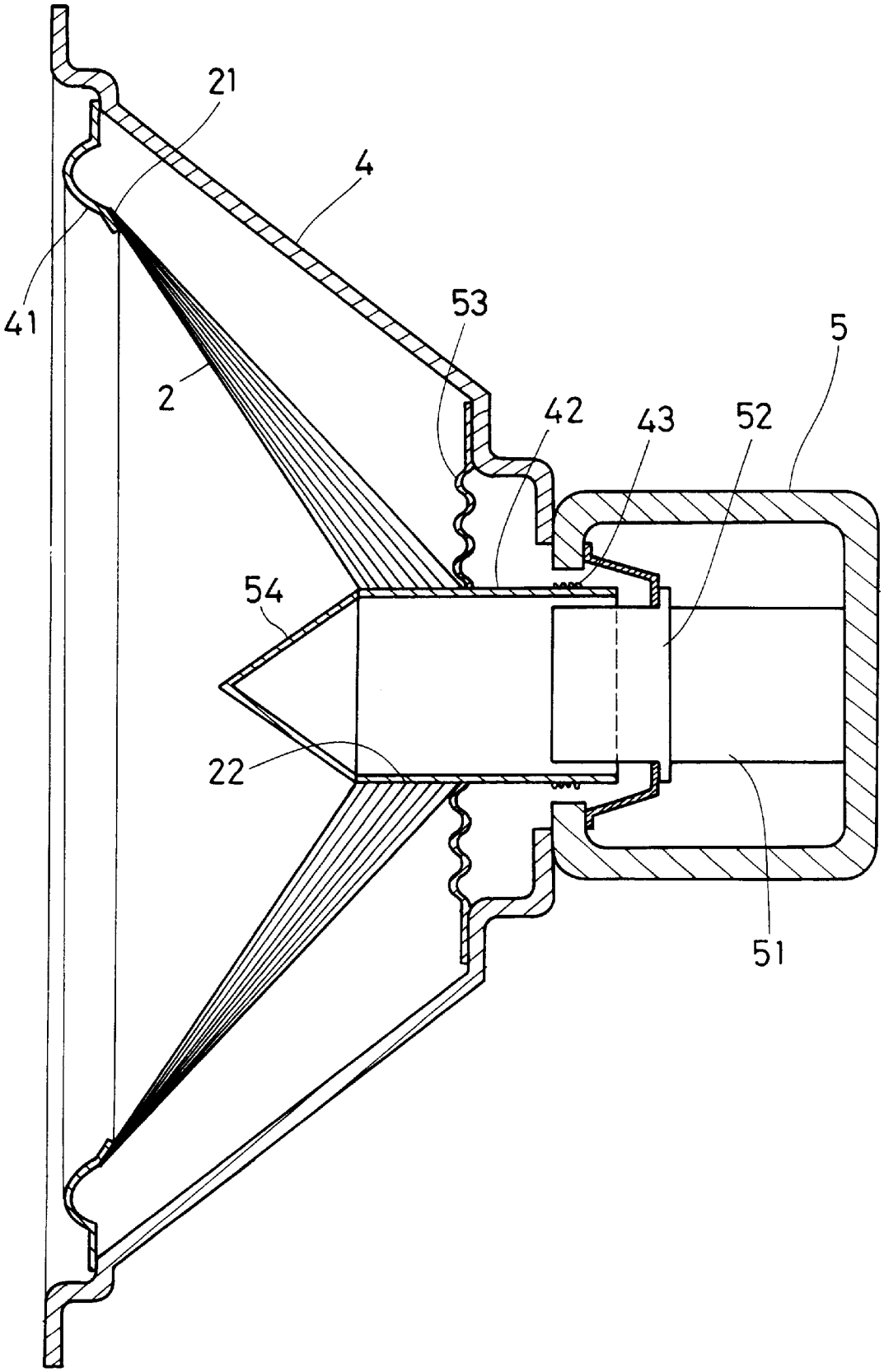
FIG. 5 is a side sectional view showing the whole structure of the loudspeaker according to the first preferred embodiment of the present invention.

FIG. 5 shows the whole structure of a loudspeaker incorporating the foregoing diaphragm 2. In this embodiment, a new feature resides in structure of the diaphragm 2, and the conventional structures can be applied to the other portions of the loudspeaker as they are. In FIG. 5, numeral 4 denotes a frame, and the large-diameter side opening edge 21 is attached to the frame 4 at its forward end via an elastic roll edge 41. On the other hand, the small-diameter side opening edge 22 of the diaphragm 2 is fixed onto the circumference of a cylindrical member 42 (corresponding to the foregoing cylindrical member 3).

A voice coil 43 is wound around the circumference of the cylindrical member 42 at its base end side. Further, a yoke 5 is provided so as to confront the voice coil 43. Numeral 51 denotes a magnet, 52 a center pole, 53 a damper and 54 a cap. The shown loudspeaker is of an inside driving type, wherein a magnetic field around the voice coil 43 is changed according to a sound signal so that a magnetic force between the voice coil 43 and the yoke 5 is changed to vibrate the diaphragm 2 forward and backward.

On the hyperbolic paraboloids forming the diaphragm 2, compressive and tensile forces are well balanced, and the surface areas thereof are theoretically equal to each other on both sides thereof. Accordingly, the hyperbolic paraboloids are used in building constructions as providing very strong structures, and hence, the diaphragm 2 is reluctant to deformation so that the dividing vibration can be suppressed. Now, consideration is given to stresses which are generated upon vibration of the diaphragm 2. When the diaphragm 2 is forced out forward from a backward (retreated) position, the small-diameter side opening edge 22 of the diaphragm 2 is pushed via the cylindrical member 42. At this time, since the large-diameter side opening edge 21 tries to stay at the position due to inertia, the opening edge 21 is subjected to a relatively backward force. In this case, if the diaphragm 2 has the conventional conical shape, tensile stresses are generated at any portions of the diaphragm 2 as described before. On the other hand, in the diaphragm 2 according to this embodiment, compressive stresses and tensile stresses are exerted simultaneously.

Figure 6:
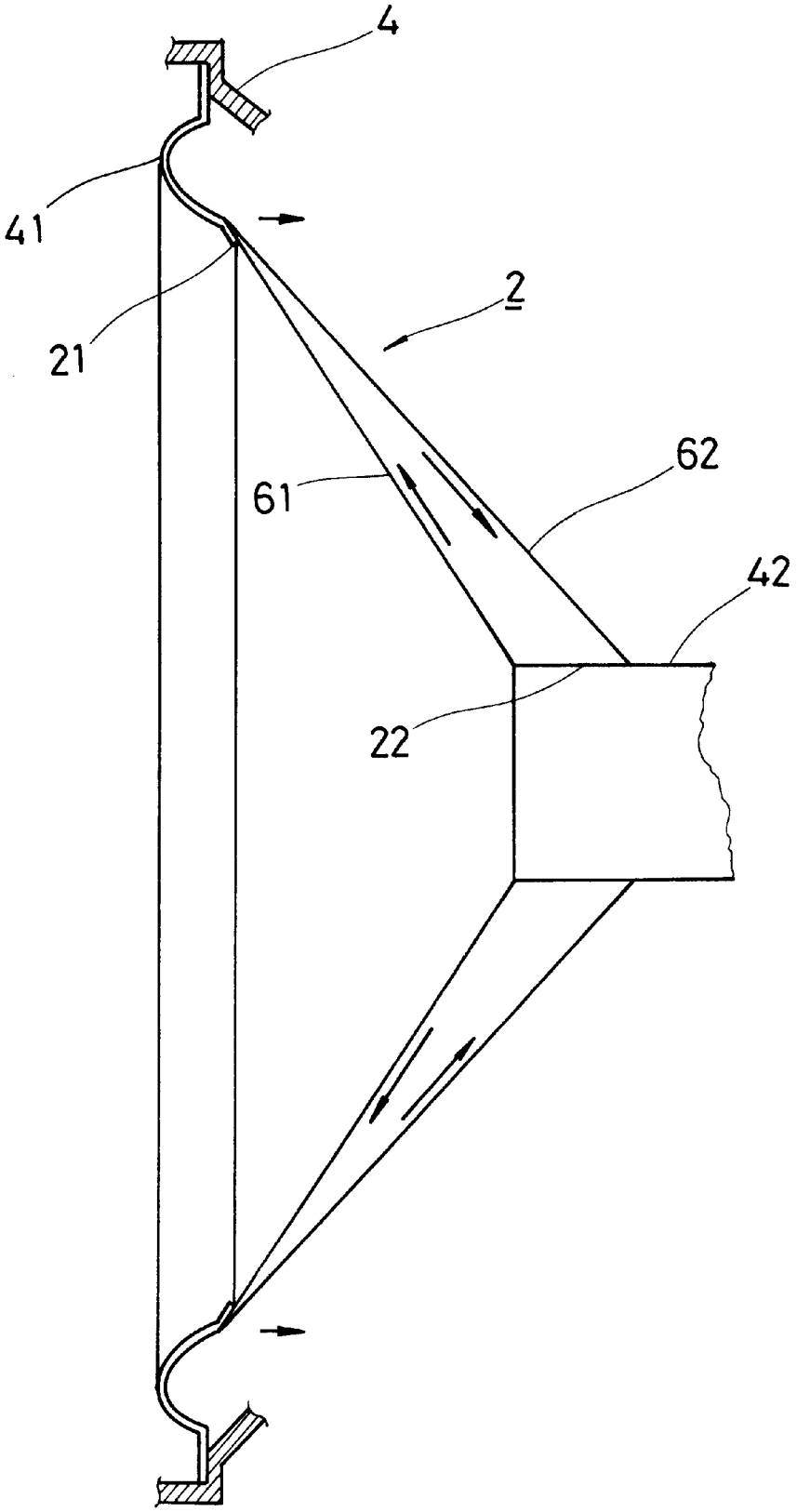
FIG. 6 is a diagram for explaining stresses acting on the diaphragm according to the first preferred embodiment of the present invention.

FIG. 6 shows the state of it, wherein a half of one of the foregoing divided regions S1 to S4 (for example, a region from A to B in FIG. 2A) is illustrated. Since the surface forming the diaphragm 2 is gradually distorted as going inward (backward) from the arcuate segment AB, when the opening edge 21 is subjected to the relatively backward force, the tensile stresses are generated at a region of the surface near a front edge (crest portion) 61 while the compressive stresses are generated at a region of the surface near a rear edge (trough portion) 62. Specifically, as described above, on the whole, the crests and the troughs are arranged alternately in the circumferential direction on the surfaces of the diaphragm 2, and hence, the tensile stresses and the compressive stresses are generated alternately with each other. Further, since the surfaces are distorted, the directions of vibration are not uniform at respective positions. Accordingly, the deformation of the diaphragm 2 is suppressed so that the dividing vibration is not likely to occur.

Figure 7:
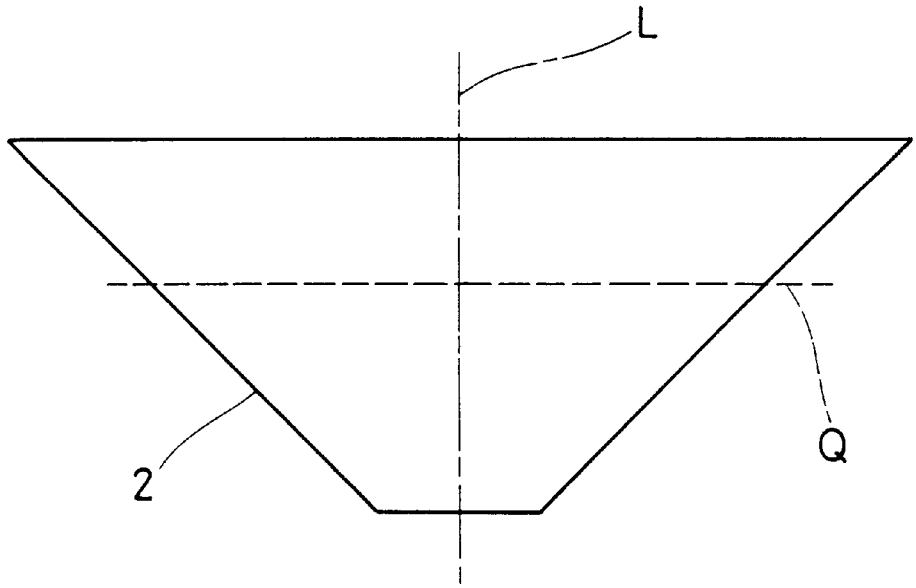
FIG. 7 is a diagram for explaining the configuration of the diaphragm in section according to the first preferred embodiment of the present invention.
Figure 19A:
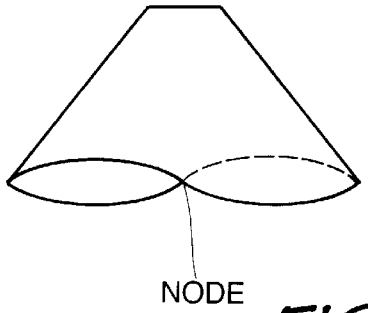
FIG.19A PRIOR ART
FIGS. 19A and 19B are diagrams for explaining generation of dividing vibration of a conventional diaphragm.
Figure 19B:
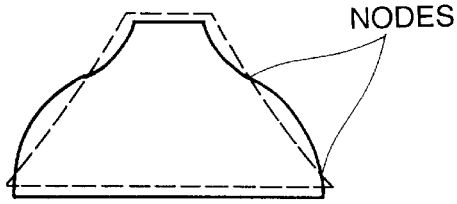
FIG.19B PRIOR ART
Figure 20:
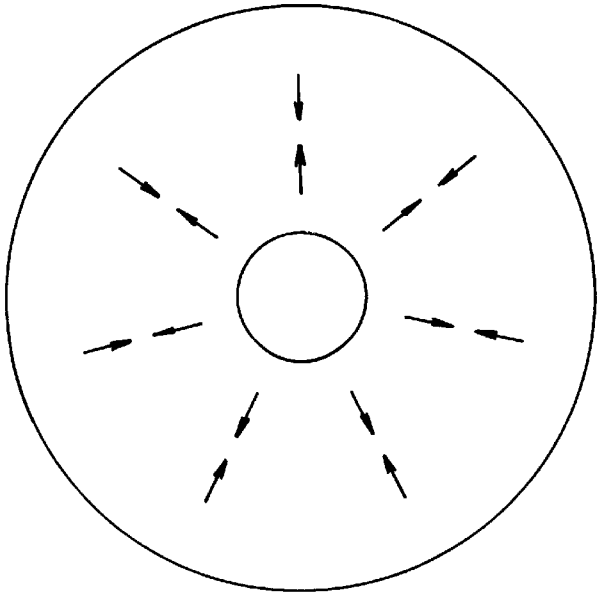
FIG.20 PRIOR ART
FIG. 20 is a diagram for explaining stresses caused in the conventional diaphragm.

Further consideration is given to the case wherein, as shown in FIG. 7, the diaphragm 2 is cut by a plane Q orthogonal to the center axis L of the diaphragm 2. In case of the conventional diaphragm having the conical shape, distances from the peripheral edge of the diaphragm in section to the center axis L are equal to each other at any positions on the peripheral edge. Thus, as in the prior art explained with reference to FIG. 19B, the nodes of vibration are generated. On the other hand, in this embodiment, since each of the surfaces of the diaphragm 2 is distorted, that is, since, microscopically, the adjacent straight lines forming the surface are located at distorted positions relative to each other, distances from the peripheral edge of the diaphragm 2 in section to the center axis L are different from each other at the respective positions on the peripheral edge in section. Thus, no nodes are generated.

As appreciated from the foregoing description, if the diaphragm 2 is formed by the hyperbolic paraboloids, the generation of the dividing vibration can be suppressed so that the good sound quality can be accomplished.

Since the diaphragm 2 is reluctant to the generation of dividing vibration, even if the diaphragm 2 is thick and large for ensuring the sufficient sound pressures at the low-frequency region, the generation of dividing vibration can be suppressed even at the high-frequency region. As a result, the loudspeaker incorporating the diaphragm 2 can be used over the wide frequency band. Further, since the degree of freedom for selection of a material of the diaphragm 2 is enlarged, the diaphragm 2 can be produced with less cost as compared with the prior art.

Figure 8:
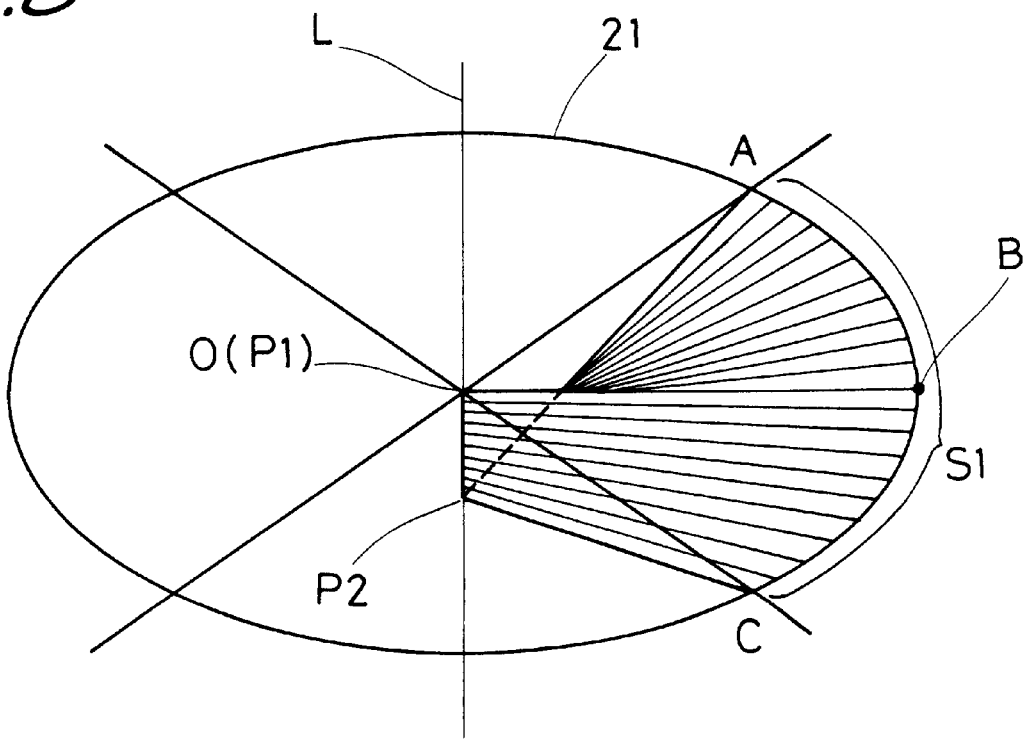
FIG. 8 is a diagram for explaining a diaphragm of a loudspeaker according to a second preferred embodiment of the present invention.

FIG. 8 shows a diaphragm of a loudspeaker according to the second preferred embodiment of the present invention. In this embodiment, the diaphragm 2 is of a so-called flat type having no depth. Specifically, the straight segment P1P2 shown in FIG. 2A is raised until P1 reaches the center O of the circle 21, and further, the diaphragm 2 is not truncated by the cylindrical member 3 so that the surfaces of the diaphragm 2 extend from the circle 21 to the center axis L. Accordingly, the crest portions (lines connecting between B and P1) of the surfaces forming the diaphragm 2 exist in the plane including the circle 21. Although FIG. 8 shows only a quarter region of the diaphragm 2 with the straight lines, the other three quarter regions have the same structure.

Figure 9:
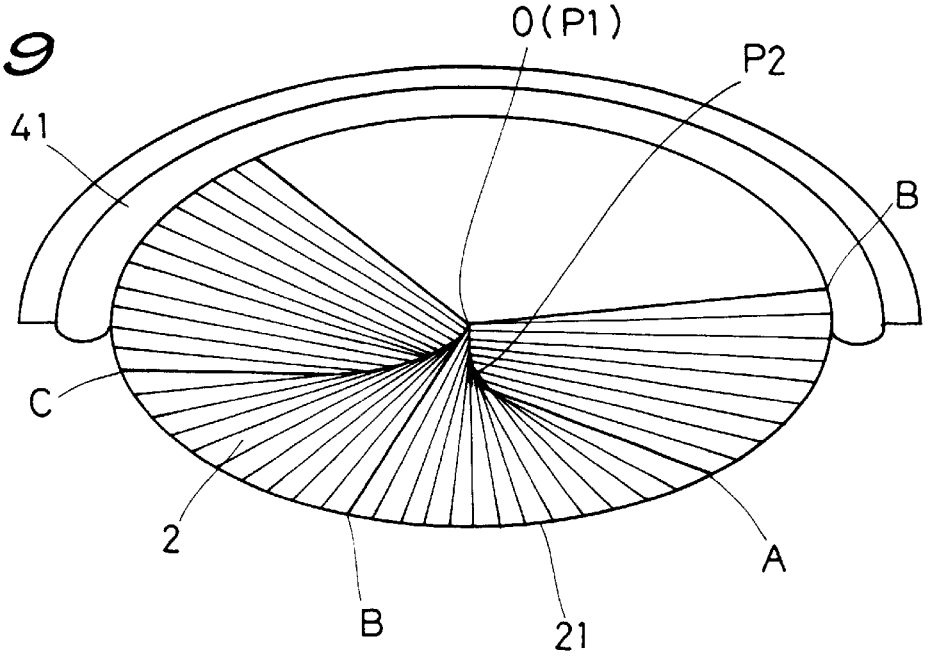
FIG. 9 is a diagram for explaining a diaphragm of a loudspeaker according to a third preferred embodiment of the present invention.
Figure 10:
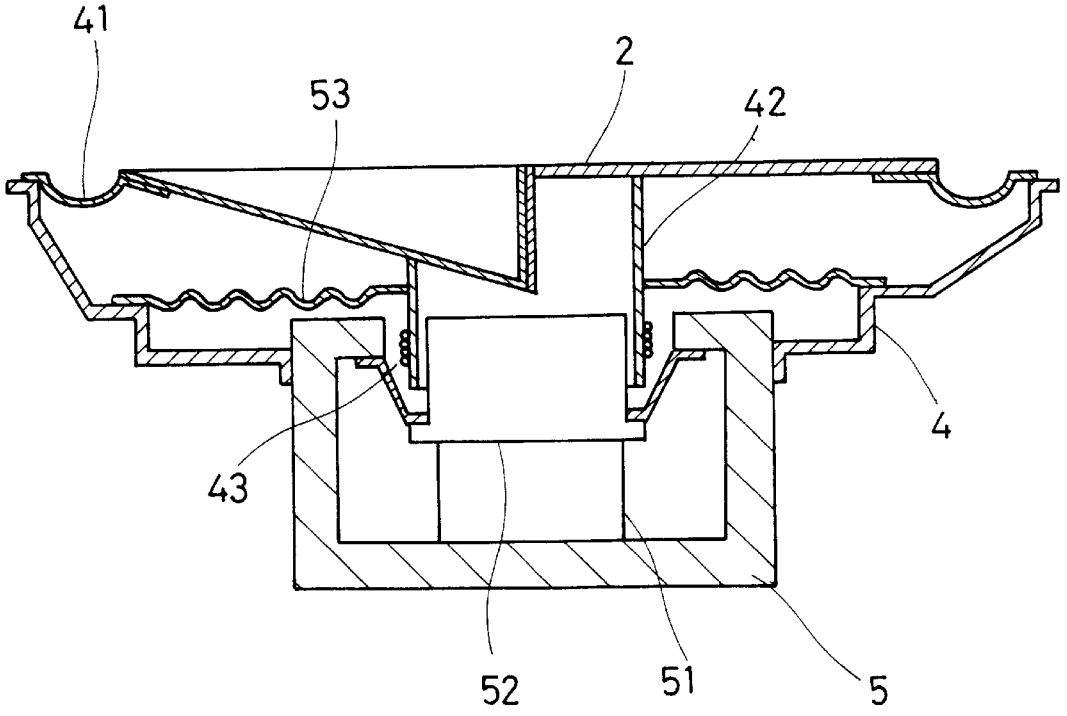
FIG. 10 is a sectional view showing a loudspeaker incorporating the diaphragm shown in FIG. 9.

FIG. 9 shows a diaphragm of a loudspeaker according to the third preferred embodiment of the present invention. In the foregoing first and second preferred embodiments, the diaphragm 2 is equally divided into four regions for the formation of the hyperbolic paraboloids. However, it is not limited to the four regions. In this embodiment, the diaphragm 2 is equally divided into three regions in the circumferential direction, and the hyperbolic paraboloids are formed per region in the same manner as in the second preferred embodiment (FIG. 8). In FIG. 9, an arcuate segment AC is obtained by trisecting a circle 21. Also in this embodiment, regions connecting between A and P2 and between C and P2 correspond to the troughs, while regions connecting between B and P1 correspond to the crests. FIG. 10 shows a loudspeaker of an inside driving type incorporating the diaphragm 2 shown in FIG. 9.

Figure 11:
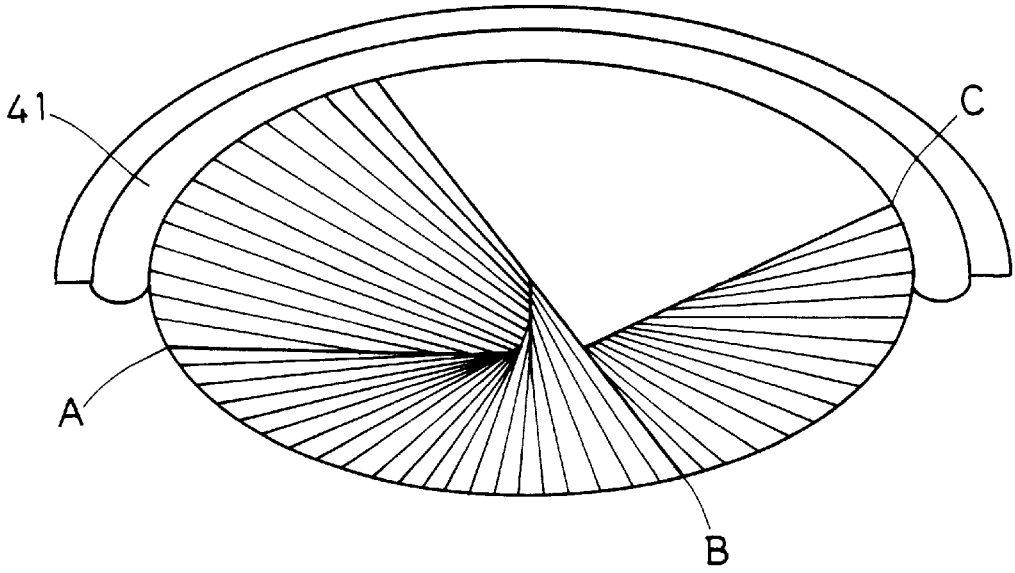
FIG. 11 is a diagram for explaining a diaphragm of a loudspeaker according to a fourth preferred embodiment of the present invention.

FIG. 11 shows a diaphragm of a loudspeaker according to the fourth preferred embodiment of the present invention. In this embodiment, the diaphragm 2 is equally divided into two regions in the circumferential direction, and the hyperbolic paraboloids are formed per region in the same manner as in the second preferred embodiment (FIG. 8). In FIG. 11, an arcuate segment AC is obtained by bisecting a circle 21. It is assumed that the diaphragm shown in FIG. 8 is called a four-division type, the diaphragm shown in FIG. 9 is called a three-division type, and the diaphragm shown in FIG. 11 is called a two-division type. When forming a diaphragm of an n-division type, if n is set to an odd number, the shapes of the surfaces arranged in a diameter direction of the diaphragm differ from each other so that the strength of the diaphragm is increased as compared with a diaphragm of an even number-division type. Further, since the states of distortion of the surfaces arranged in the diameter direction differ from each other, the resonance noise can be suppressed.

Figure 12:
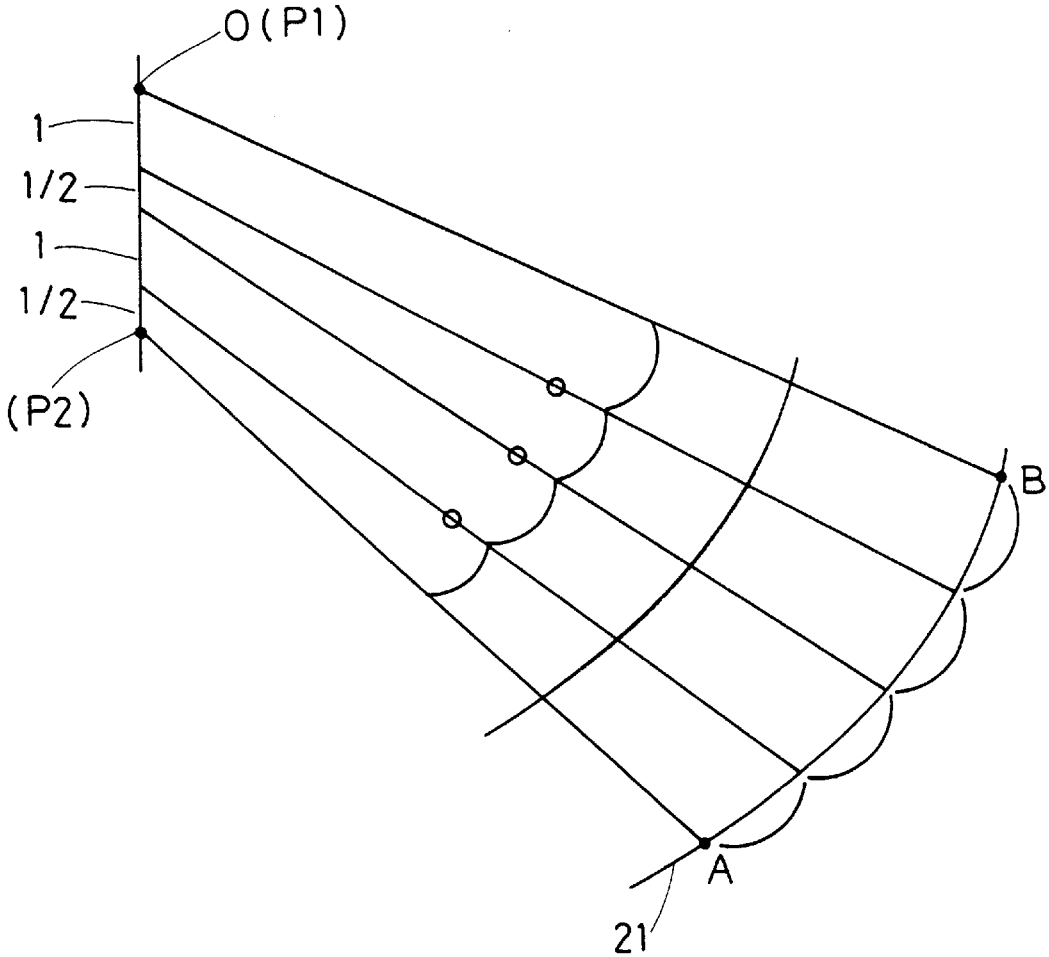
FIG. 12 is a diagram for explaining one example of a diaphragm producing method.

Since the weight of the diaphragm can be reduced as a value of n is set to be smaller, it is preferable that the value of n is set to 10 or less. On the other hand, the diaphragms shown in FIGS. 8, 9 and 11 may also be used as being reversed. Further, as shown in FIG. 12, the hyperbolic paraboloids may be formed such that the straight segment P1P2 is divided at the ratio of 1:½:1:½ in length and a hyperbolic paraboloid is formed between each of the divided regions of the straight segment P1P2 and each of quadrisected regions of the arcuate segment AB. Specifically, the divided region of "1" of the straight segment P1P2 is further divided equally into k regions, the quadrisected region of the arcuate segment AB is further divided equally into k regions, and the corresponding equally divided points are connected by straight lines so as to form a hyperbolic paraboloid. Similarly, the divided region of "½" of the straight segment P1P2 is further divided equally into k regions so as to form a hyperbolic paraboloid in the same manner. In the diaphragm thus formed, boundary lines between the adjacent hyperbolic paraboloids, that is, boundary lines indicated by circles in FIG. 12, become crests.

Figure 13A:
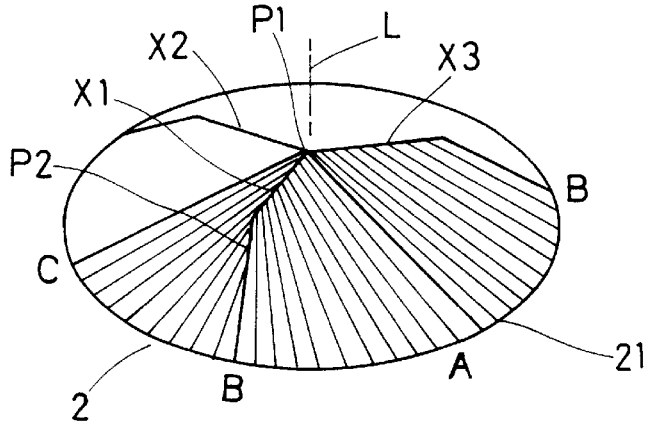
Figure 13B:
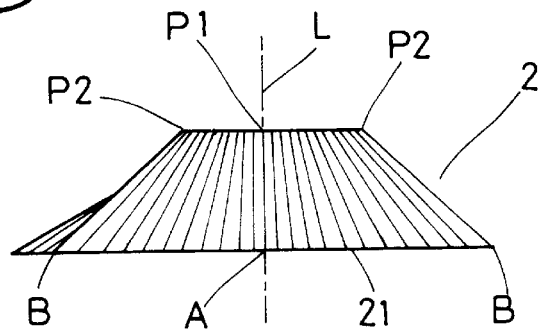
Figure 13C:
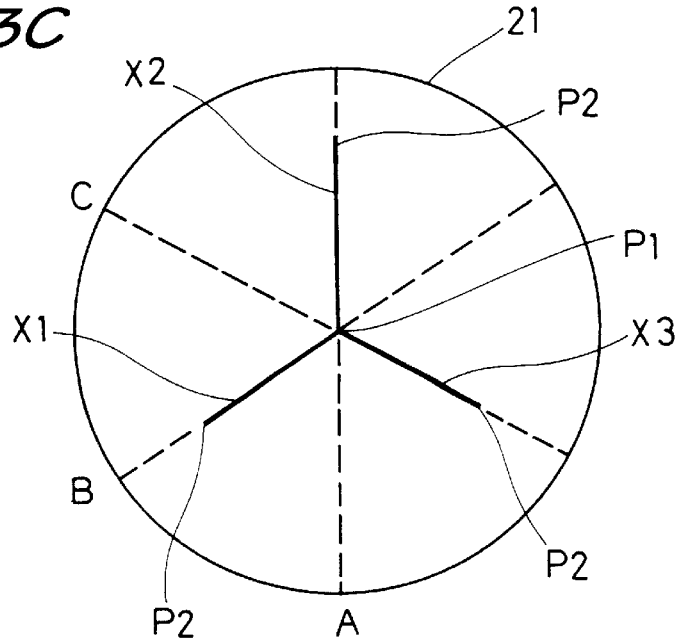

FIGS. 13A to 13C show a diaphragm of a loudspeaker according to the fifth preferred embodiment of the present invention, wherein FIG. 13A is a perspective view, FIG. 13B is a side view and FIG. 13C is a plan view. In this embodiment, three straight lines located at positions higher (forward side) than a plane including a circle 21 and extending radially from the center axis L at 120 degrees relative to each other along a plane parallel to the plane including the circle 21 are given as X1, X2 and X3, and inner and outer ends of each of the straight lines X1, X2 and X3 are given as P1 and P2, respectively. By moving a straight line connecting between A and P1 along an arcuate segment AB and along the straight segment P1P2 and moving a straight line connecting between C and P1 along an arcuate segment CB and along the straight segment P1P2, hyperbolic paraboloids are formed. Specifically, for example, by equally dividing AB into k regions, equally dividing P1P2 into k regions and connecting between the corresponding equally divided points by straight lines, a hyperbolic paraboloid is formed. In FIG. 13A, AC is a trisected arcuate segment of the circle 21, and B is the middle point of AC. Seeing from above, each of X1 to X3 and B are located on a straight line as shown in FIG. 13C.

Figure 14A:
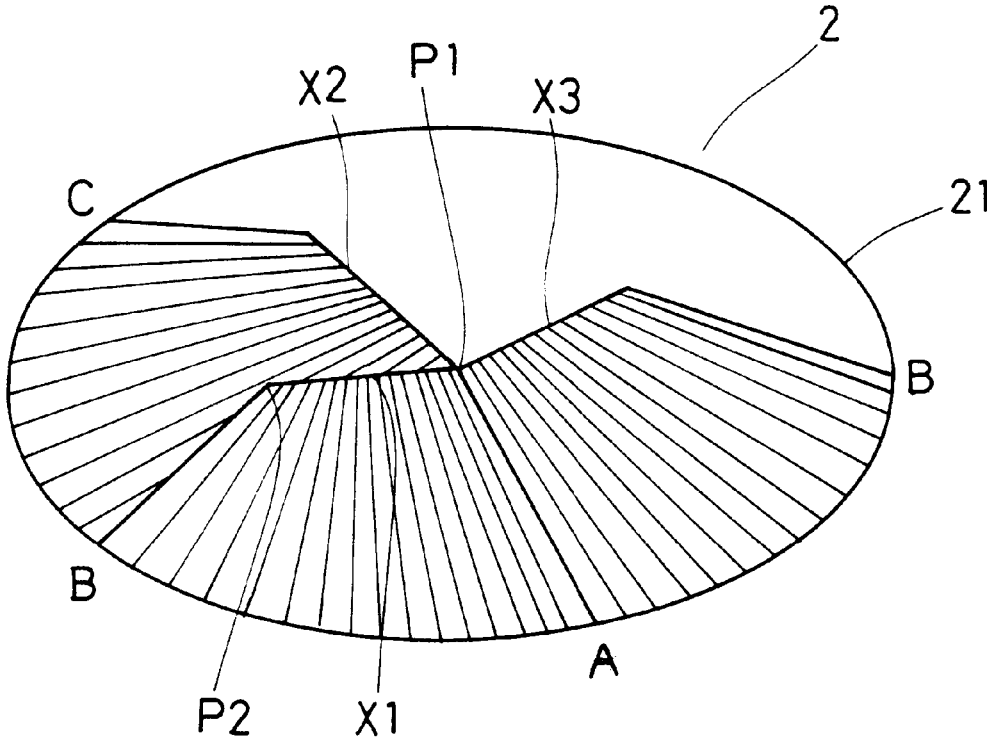
Figure 14B:
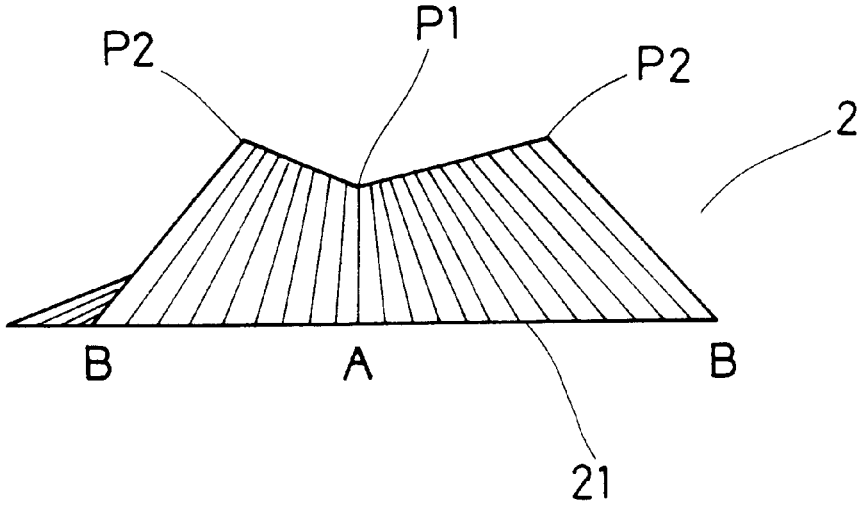

FIGS. 14A and 14B show a diaphragm of a loudspeaker according to the sixth preferred embodiment of the present invention, wherein FIG. 14A is a perspective view and FIG. 14B is a side view. In the fifth preferred embodiment, P1 and P2 of each of X1 to X3 are set at the same height relative to the circle 21. On the other hand, P2 may be located upward or downward relative to P1 so as to change a characteristic of the diaphragm. In the sixth preferred embodiment, as shown in FIGS. 14A and 14B, the outer ends P2 of X1 to X3 are set higher than the inner ends P1 in the diaphragm shown in FIGS. 13A to 13C. The diaphragms shown in FIGS. 13A–13C and 14A–14B may be used as being reversed, that is, either in forward orientation (shown in the figures) or in backward orientation.

Figure 15:
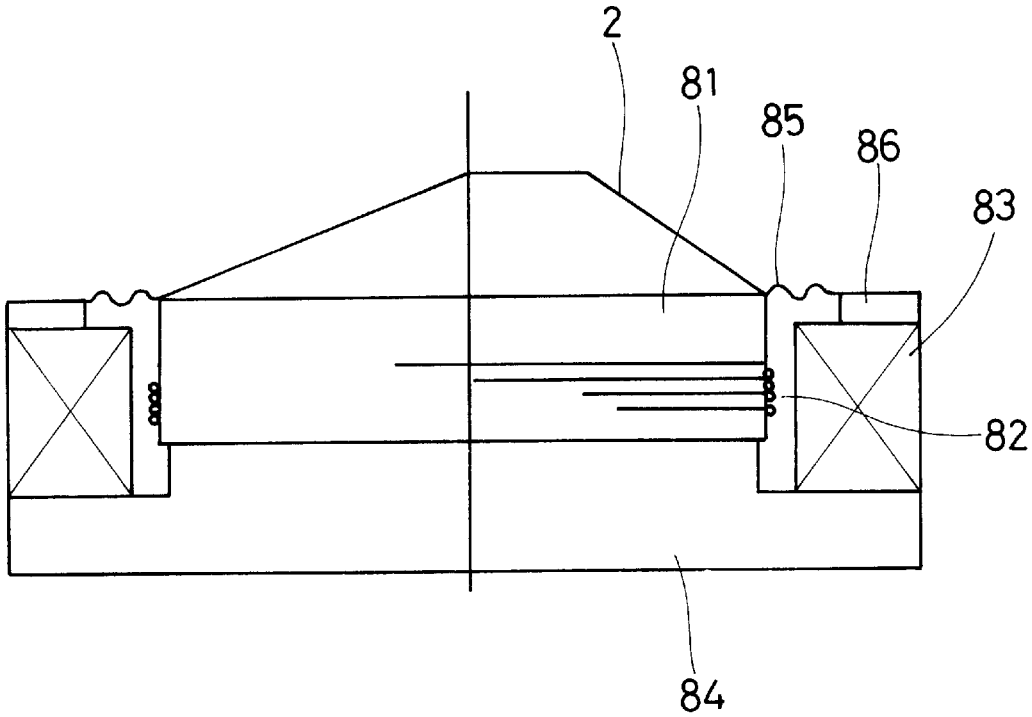
FIG. 15 is a sectional view showing a loudspeaker incorporating the diaphragm shown in FIGS. 13A–13C.

FIG. 15 shows a loudspeaker of an outside driving type incorporating the diaphragm 2 shown in FIGS. 13A to 13C. The diaphragm 2 is provided at one end of a cylindrical member 81 working as a coil bobbin. A voice coil 82 is wound around the cylindrical member 81, and a pole piece 83 is disposed at the other end side of the cylindrical member 81. A magnet 84 is in the form of a ring surrounding the voice coil 82. Numeral 85 is a corrugated damper, and the diaphragm 2 is supported to a support portion 86 via the damper 85. The lightweight diaphragm 2 may be easily produced through press working. In this case, it may be arranged that the diaphragm 2 and the bobbin 81 are formed integral with each other using, for example, a titanium metal plate.

Figure 16:
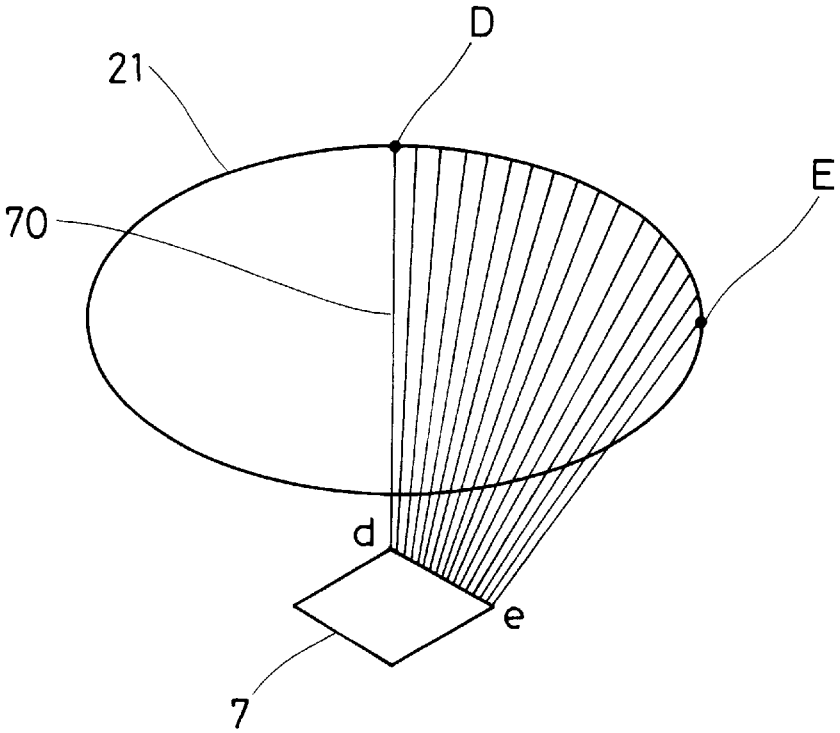
FIG. 16 is a diagram for explaining a diaphragm of a loudspeaker according to a seventh preferred embodiment of the present invention.

FIG. 16 shows a diaphragm of a loudspeaker according to the seventh preferred embodiment of the present invention. The shapes of the hyperbolic paraboloids are not limited to the foregoing examples. For example, a conoid hyperbolic paraboloid may be formed between an arcuate segment (chord) and a straight line parallel thereto. FIG. 16 shows the diaphragm having such conoid hyperbolic paraboloids. Specifically, a circle (large-diameter side opening edge) 21 is equally divided into, for example, four regions and, using a square 7 having a common center axis with the circle 21, a straight line 70 is moved along a quadrisected arcuate segment DE of the circle 21 and along a side de of the square 7 parallel to the arcuate segment DE so as to form a hyperbolic paraboloid between the arcuate segment DE of the circle 21 and the side de of the square 7. Similarly, hyperbolic paraboloids are formed with respect to the other three quarter arcuate segments of the circle 21. Also in this embodiment, the strength of the hyperbolic paraboloids is large and, when cut by a plane orthogonal to the center axis of the circle 21, distances from the peripheral edge of the diaphragm in section to the center axis are different from each other at the respective positions on the peripheral edge in section. Thus, the dividing vibration can be suppressed.

The shape of the large-diameter side opening edge 21 of the diaphragm is not limited to circular, but may be polygonal, such as triangular or quadrilateral. In this case, for example, a small-diameter side opening edge may have a circular shape so as to form conoid hyperbolic paraboloids in a manner similar to FIG. 16.

Figure 17A:
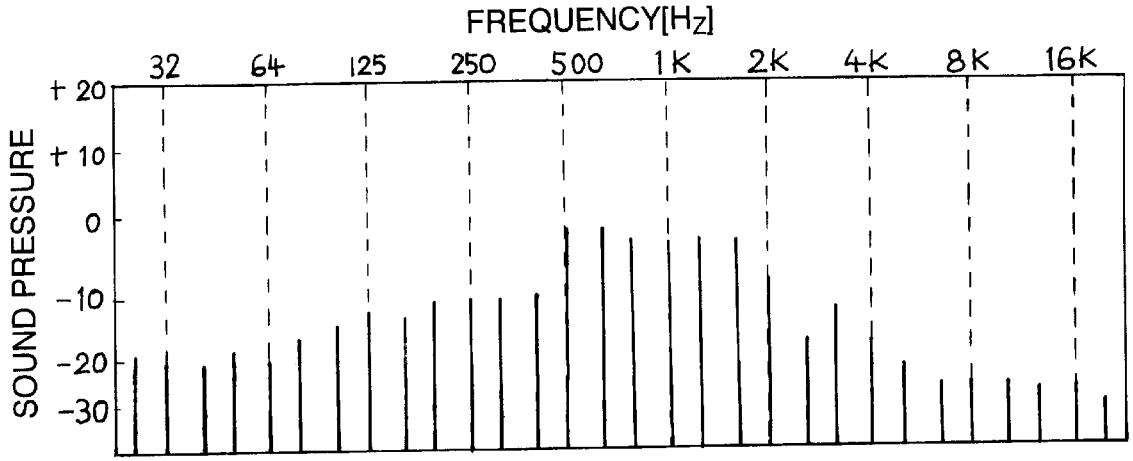
Figure 17B:
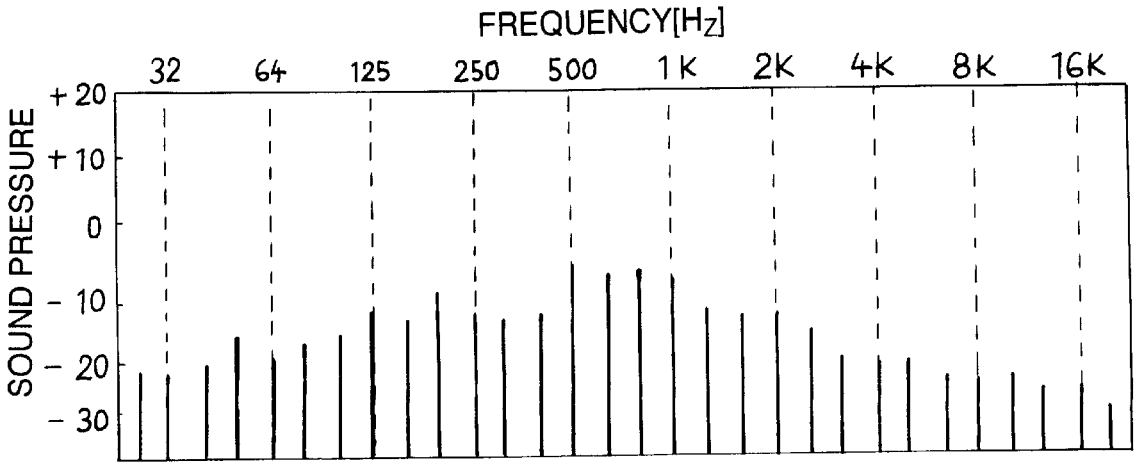
Figure 18:
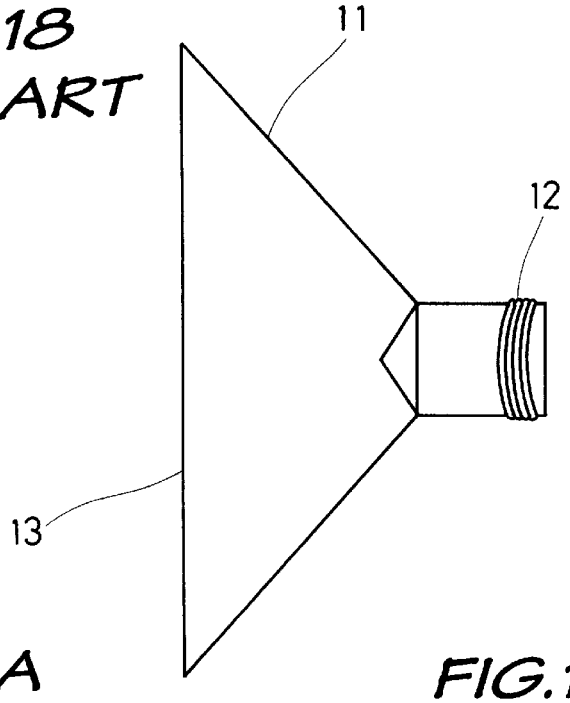
FIG.18 PRIOR ART
FIG. 18 is a diagram for explaining a conventional loudspeaker.

Relationships between sound pressures and frequencies were examined with respect to the conventional loudspeaker shown in FIG. 18 and the loudspeaker shown in FIGS. 9 and 10. The results are shown in FIGS. 17A and 17B, wherein the axis of ordinate represents the scale of a recorder and corresponds to the sound pressure although not directly representing dB. FIG. 17A shows the results about the conventional loudspeaker, while FIG. 17B shows the results about the loudspeaker shown in FIGS. 9 and 10. In each of the loudspeakers, carbon fiber was used as a material of a diaphragm. In the conventional loudspeaker, a diameter and a depth of the diaphragm were set to 320 mm and 65 mm, respectively. On the other hand, in the loudspeaker shown in FIGS. 9 and 10, a diameter of the circle 21 of the diaphragm was set to 320 mm while a depth of the diaphragm was set to 55 mm. As seen from the results, the change of the sound pressures relative to the change of the frequencies is more gradual in the loudspeaker shown in FIGS. 9 and 10 as compared with the conventional loudspeaker so that the good sound quality can be achieved.

As described above, according to the loudspeaker of each of the foregoing preferred embodiments, since the diaphragm is formed by the hyperbolic paraboloids, the dividing vibration can be suppressed.

While the present invention has been described in terms of the preferred embodiments, the invention is not to be limited thereto, but can be embodied in various ways without departing from the principle of the invention as defined in the appended claims.

What is claimed is:

1. A loudspeaker comprising a diaphragm divided into a plurality of regions, each region having a first segment forming a peripheral edge thereof and a second segment which is not located in the same plane with respect to said first segment, said first segment having a first end point and a middle point on said peripheral edge, said second segment corresponding to the center axis of said diaphragm and substantially orthogonal to said first segment, said second segment having a first point and a second point, each region comprising at first hyperbolic paraboloid which is defined by moving a straight line connecting said first segment and second segment, the outer end of said line connected to said first segment moving at a constant speed from said middle point to said first end point of said first segment and the outer end of said line connected to said second segment moving at a constant speed from said first point to said second point.

2. The loudspeaker according to claim 1, wherein said first segment further includes a second end point and each region forms a second hyperbolic paraboloid which is defined by moving a straight line connecting said first segment and second segment, the outer end of said line connected to said first segment moving at a constant speed from said middle point to said second end point of said first segment and the outer end of said line connected to said second segment moving at a constant speed from said first point to said second point.

3. The loudspeaker according to claim 1, wherein the number of divided regions of said diaphragm is an odd number.

4. A loudspeaker comprising a diaphragm divided into a plurality of regions, each region having a first segment forming a peripheral edge thereof and a second segment which is not located in the same plane with respect to said first segment, said first segment having a first end point and a middle point on said peripheral edge, said second segment extending radially from the center axis of said diaphragm, said second segment having a first point and a second point, each region comprising at first hyperbolic paraboloid which is defined by moving a straight line connecting said first segment and second segment, the outer end of said line connected to said first segment moving at a constant speed from said first end point to said middle point of said first segment and the outer end of said line connected to said second segment moving at a constant speed from said first point to said second point.

5. The loudspeaker according to claim 4, wherein said first segment further includes a second end point and each region forms a second hyperbolic paraboloid which is defined by moving a straight line connecting said first segment and second segment, the outer end of said line connected to said first segment moving at a constant speed from said second point to said middle point of said first segment and the outer end of said line connected to said second segment moving at a constant speed from said first point to said second point.

6. The loudspeaker according to claim 4, wherein the number of divided regions of said diaphragm is an odd number.

* * * * *